US006109613A

United States Patent [19]

Crompton et al.

[11] Patent Number: 6,109,613

[45] Date of Patent: Aug. 29, 2000

[54] AMUSEMENT MACHINE

[75] Inventors: Gordon James Crompton; David Anthony Chapman, both of Broadstairs, United Kingdom

[73] Assignee: Cromptons Leisure Machines Limited, Kent, United Kingdom

[21] Appl. No.: 09/230,655

[22] PCT Filed: Jul. 31, 1997

[86] PCT No.: PCT/GB97/02078

§ 371 Date: Jan. 29, 1999

§ 102(e) Date: Jan. 29, 1999

[87] PCT Pub. No.: WO98/04326

PCT Pub. Date: Feb. 5, 1998

[30] Foreign Application Priority Data

Jul. 31, 1996 [GB] United Kingdom ..... 9616021

[51] Int. Cl.[7] ..... A63F 9/02; G07F 17/38

[52] U.S. Cl. ..... 273/354; 273/348; 273/402; 273/405

[58] Field of Search ..... 273/355, 356, 273/371, 394, 398, 405, 407, 402, 348, 354, 399, 440

[56] References Cited

U.S. PATENT DOCUMENTS

| | | | |
|---|---|---|---|
| 4,109,914 | 8/1978 | Matsumoto . | |
| 4,213,612 | 7/1980 | Wildman et al. . | |
| 5,460,384 | 10/1995 | Seidel et al. . | |
| 5,501,466 | 3/1996 | Welch et al. | 273/355 |
| 5,511,794 | 4/1996 | Katamoto . | |

FOREIGN PATENT DOCUMENTS

| | | |
|---|---|---|
| 2 112 654 | 7/1983 | United Kingdom . |
| 2218644 | 11/1989 | United Kingdom . |

*Primary Examiner*—Raleigh W. Chiu
*Attorney, Agent, or Firm*—McDermott, Will & Emery

[57] ABSTRACT

The invention provides a game apparatus in which playing pieces (12) are projected at a target (2) by a player, comprising a player console (1), a target panel (2) spaced apart from the player console, playing piece projector (3) disposed at the player console for projecting a playing piece (1,2) provided by a player towards the target panel, at least one winner area (16) in the target panel and dimensioned to receive a playing piece (12) projected from the project of, and a prize issuer in response to a projected playing piece being received in the winner area. A movable cover (17) is provided to alternately obscure and expose the or each winner area (16) in a regular or random fashion.

7 Claims, 2 Drawing Sheets

AMUSEMENT MACHINE

This invention relates to an amusement machine, and more particularly to a game apparatus in which playing pieces are projected at a target by a player.

The playing pieces are small articles such as balls or coins. In the context of this specification, the term "coin" is used to indicate coins of every day currency and also non-monetary discs or tokens of a generally similar kind.

Amusement machines are known in which coin projecting means are used by a player to project coins towards a target panel. In GB-A-2 112 654, the coin projecting means comprise a rotatable, ribbed drum positioned beneath coin entry slots. The target panel incorporates a plurality of baskets containing sensors actuated by a coin passing through a basket to secure a predetermined award. One of the baskets may be movable. The player has some control over the projection of a coin by selecting a coin slot in which to insert a coin at any particular time. However, the ribbed drum gives an unpredictable coin path.

GB-A-2 218 644 discloses a coin projecting game apparatus in which a rotating target carousel is provided. This provides a plurality of target panels each having at least one jackpot opening dimensioned to receive a projected coin. The coin projecting means include a resilient impeller wheel driven at a constant high speed and positioned in a channel-like track. A coin is projected into the track so is to make an interference fit with the wheel, which thereby projects the coin with high velocity from the track. A movable coin deflector is incorporated in the track so as to randomise the direction of the projected coin.

We have sought to provide an improved game apparatus in which a greater degree of skill can be exercised by the player. In one aspect, this involves the player being able to move the coin projecting means so as to direct projected coins to a desired portion of the target panel. In a second aspect, which may be separate or combined with the first aspect, winner openings in the target panel are alternately opened and closed so that the player has to exercise skill in timing the projection of playing pieces such as coins as well as controlling their direction.

In one aspect, the invention provides a game apparatus in which playing pieces are projected at a target by a player, comprising a player console, a target panel spaced apart from the player console, playing piece projecting means disposed at the player console for projecting a playing piece provided by a player towards the target panel, at least one winner area in the target panel and dimensioned to receive a playing piece projected from the projecting means, and means for issuing a prize in response to a projected playing piece being received in the or a winner area, characterised in that a movable cover is provided to alternately obscure and expose the or each winner area in a regular or random fashion. The playing pieces are preferably coins.

In another aspect, the invention provides a coin projecting game apparatus, comprising a player console, a target panel spaced apart from the player console, and coin projecting means disposed at the player console for projecting a coin provided by a player towards the target panel, wherein the coin projecting means comprise a rotatable wheel having a resilient periphery, and a coin guide surface having a central portion which is curved concentrically with a part of said wheel periphery and arranged close to or in contact therewith, and portions of the coin guide surface, on either side of the central portion, extending tangentially away from the wheel periphery; whereby, in use, a coin inserted between the guide surface and trailing side of the wheel, relative to the direction of rotation, is carried around the central portion by rotation of the wheel, with compression of the wheel periphery, and projected from the leading side of the wheel, and wherein the coin projecting means are movable by the player so as to direct projected coins to a desired portion of the target panel.

The coin projecting means may be integral with a coin entry slot and validation apparatus. The combined coin entry and coin projecting means may be movable transversely relative to the direction of coin projection, manually or with power assistance, under the control of the player whereby the player can direct the projected coins to a selected area on the target panel.

The coin projecting means preferably comprise an impeller wheel as described above. Both aspects of the invention may be combined in a single game apparatus.

Reference is now made to the accompanying drawings, in which.

Figure 1:
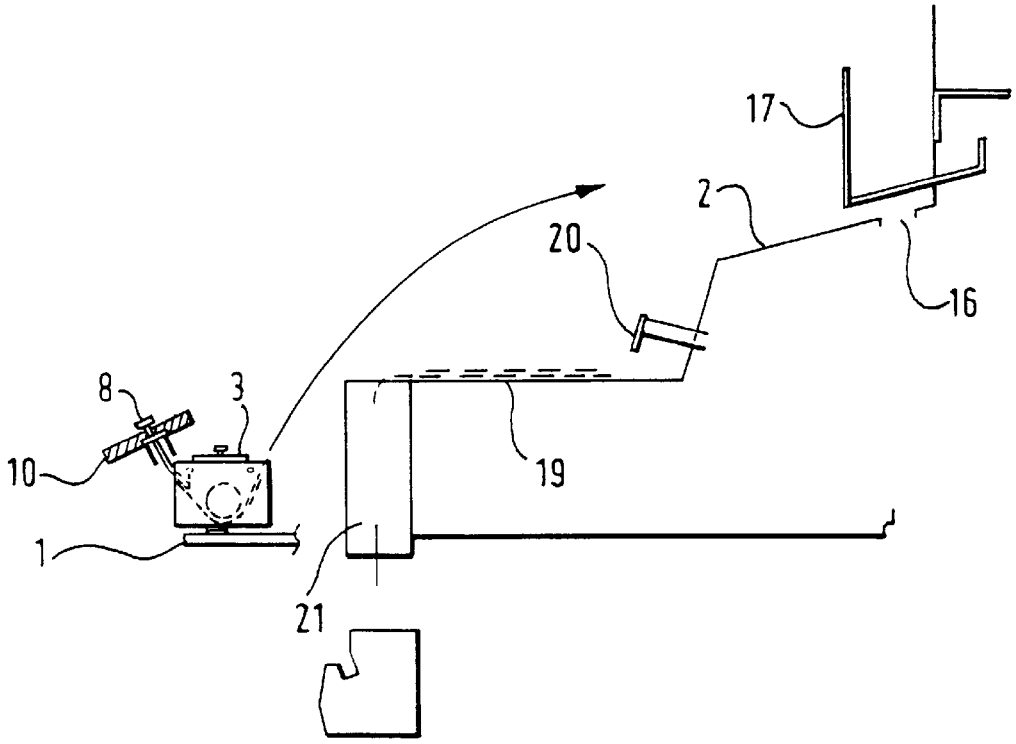
FIG. 1 is a diagrammatic side view of an amusement machine according to a preferred embodiment of the invention.
Figure 2:
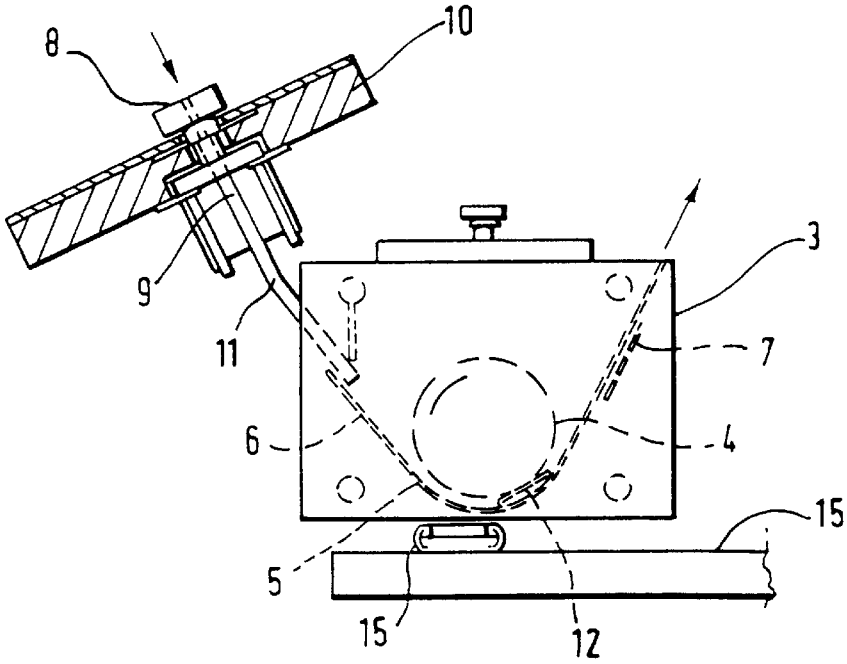
FIG. 2 is a diagrammatic side view, on enlarged scale, of the coin entry block and flip unit of the machine in FIG. 1.
Figure 4:
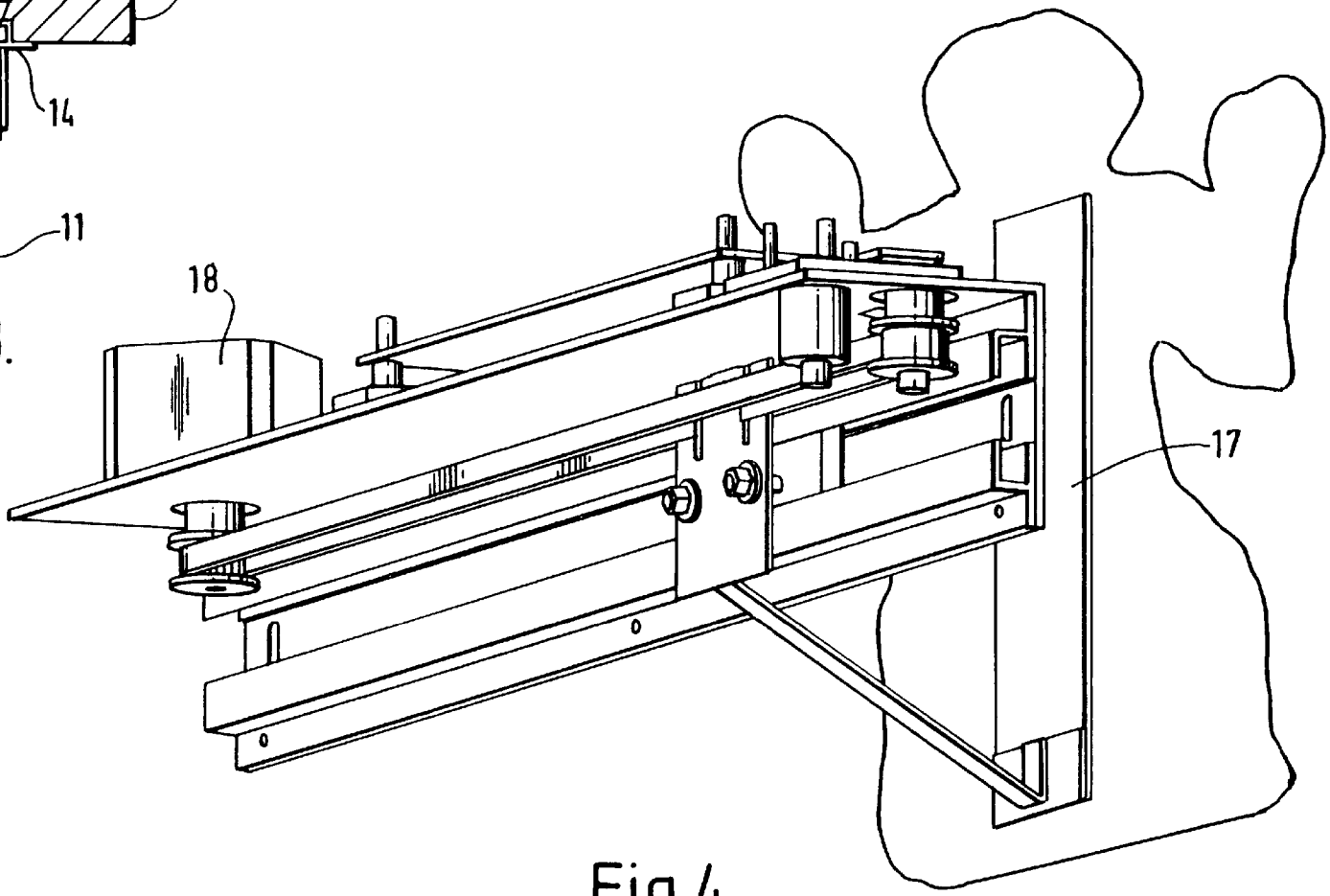
FIG. 4 shows a movable cover member which forms part of the machine.
Figure 3:
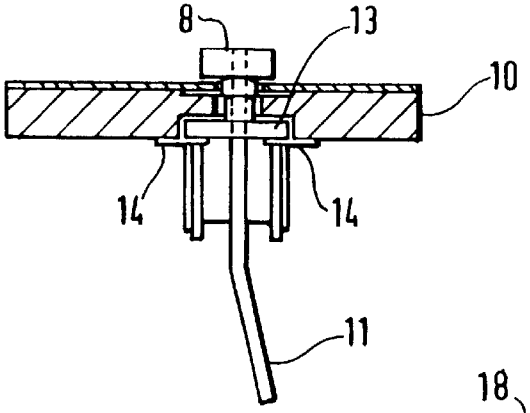
FIG. 3 shows some details of the coin entry block.

A preferred embodiment of the invention as shown in the drawings includes a cabinet housing a player console 1 towards the front, and a target panel 2 at the rear of the cabinet and somewhat raised relative to the player console. The player console includes a coin flip unit 3 consisting of a wheel 4 designed to rotate at high speed adjacent a tower coin guide surface 5. The wheel 4 rotates in a direction such that the lower part moves in the direction of the target panel 2. The wheel 4 is provided with a resilient rubber ring around its periphery or the wheel as a whole is made of foam rubber. A U-shaped coin guide channel 5 is adjacent the lower part of the wheel, a central portion of the channel being curved concentrically with the adjacent part of the wheel periphery. Portions 6, 7 of the coin guide channel, on either side of the central portion, extend tangentially away from the wheel periphery. A coin entry slot 8 and coin validator 9 are accommodated in a coin entry block 10 which is integral with the coin guide channel 5 in the flip unit 3.

The player inserts a coin into the entry slot 8 and it passes into the validator unit 9, which checks that it is a valid coin, and allows the coin to pass down a coin entry chute 11 into the guide channel 5. Any coins rejected by the validator unit may be retained in a separate part of the machine or returned to the player. A coin 12 which has entered the guide channel 5 is forced around the lowermost part by the rotation of the wheel 4, the coin passing in interference fit between the wheel and the channel, with the rubber periphery of the wheel being compressed. After passing around the lowermost part of the channel 5, the coin 12 is projected from the other side of the channel by the rotating wheel 4. The dimensions of the channel 5 and the wheel 4, and the speed of rotation of the wheel, are coordinated so as to project the coins consistently to the target panel 2.

The combined coin entry block 10 and coin flip unit 3 is slidable from side to side under the control of the player, so that the player can direct the projected coins to a desired part of the target panel 2. To achieve this, the coin entry block 10 is mounted on a bearing plate 13 which is designed to slide on a slide rail 14 transverse to the direction of coin projection. The flip unit 3 is supported by ball bearings by means of which it can slide over a support surface 15. Sliding can be effected manually by the player, for example by gripping the coin entry block 10. Alternatively, power assistance can be provided by an electric motor, left and right direction switches then being provided for operation by the player. As an alternative, a joystick may be provided for left and right movement.

An upper portion of the target panel 2 includes three winner openings 16 adapted to receive a projected coin. Within each opening is a coin sensor, capable of generating a signal when a coin is received by a winner opening. The signal is arranged to trigger the payout of a prize to the player, such as a release of coins from the machine.

A movable cover member 17 is provided on the upper part of the target panel, so as to alternately obscure and expose the winner openings. There are three winner openings in a straight line, and the cover member 17 can slide backwards and forwards across the front of the openings. The cover member can be adapted to slide backwards and forwards in a regular fashion, or it can move randomly under control of a stepper motor 18. A coin will only be received by a winner opening if the opening is not obscured by the cover member 17. This therefore introduces an additional skill feature for the player. In addition to directing a projected coin towards a selected winner opening, the time of entry of the coin into the coin slot has to be selected so that the appropriate winner opening is not obscured by the cover member when the projected coin reaches it.

The moveable cover 17 transversely tracks the flipper unit 3 and hence is interactive with the player. The degree to which the cover 17 tracks the coin flipper 3 is software controlled, which allows the difficulty of hitting the winning openings 16 to be adjusted. To all intents and purposes the cover 17 does not actually cover the winning openings 16 completely and is never stationary. It acts as a device to limit the chance of winning and also to encourage the player to move the coin flipper 3 to another opening.

As shown in the drawings, the lower part of the target panel incorporates a playfield 19 which collects coins projected onto the target panel but which do not enter the winner openings. Coins which enter the winner openings may also pass onto the playfield. The playfield 19 is swept by several reciprocating paddles 20, which disturb the pattern of coins on the playfield. Coins may be swept over the forward edge of the playfield 19. Such coins may be retrieved from a win chute 21 by the player.

What is claimed is:

1. A game apparatus in which playing pieces are projected at a target by a player, comprising a player console, a target panel spaced apart from the player console, playing piece projecting means disposed at the player console for projecting a playing piece provided by a player towards the target panel, at least one winner area in the target panel and dimensioned to receive a playing piece projected from the projecting means, means for issuing a prize in response to a projected playing piece being received in the or a winner area, and a movable cover provided to alternately obscure and expose the or each winner area in a regular or random fashion, characterised in that the playing piece projecting means are movable transversely relative to the direction of playing piece projection under the control of the player whereby the player can direct the projected playing pieces to a selected portion of the target panel, and the movable cover is movable transversely to the direction of projection, across the front of the or each winner area.

2. A game apparatus according to claim 1, in which movement of the cover is responsive to movement of the projecting means, whereby the proportion of time that the cover obscures a winner area varies according to the position of the projecting means.

3. A game apparatus according to claim 1, having a plurality of winner areas in line on the target panel, the movable cover being slidable back and forth across the front of the winner areas.

4. A game apparatus according to claim 1, in which the playing pieces are coins (12).

5. A game apparatus according to claim 4, in which the winner area is an opening in the target panel dimensioned to be capable of receiving a projected coin.

6. A game apparatus according to claim 4, wherein the coin projecting means comprise a rotatable wheel having a resilient periphery, and a coin guide surface having a central portion which is curved concentrically with a part of said wheel periphery and arranged close to or in contact therewith, and portions of the coin guide surface, on either side of the central portion, extending tangentially away from the wheel periphery; whereby, in use, a coin inserted between the guide surface and trailing side of the wheel, relative to the direction of rotation, is carried around the central portion by rotation of the wheel, with compression of the wheel periphery, and projected from the leading side of the wheel.

7. A game apparatus according to claim 4, in which the coin projecting means are integral with a coin entry slot and validation apparatus.

* * * * *